US005436526A

United States Patent [19]

Hohaus et al.

[11] Patent Number: 5,436,526

[45] Date of Patent: Jul. 25, 1995

[54] METHOD OF PLACING A SINGLE-CAPPED ELECTRIC LAMP IN A LAMPHOLDER, SINGLE-CAPPED ELECTRIC LAMP DESIGNED FOR THIS PURPOSE, AND LUMINAIRE PROVIDED WITH THE SINGLE-CAPPED ELECTRIC LAMP

[75] Inventors: Karl-Heinz Hohaus, Linnich; Klaus E. Meinecke, Aachen, both of Germany

[73] Assignee: U.S. Philips Corporation, New York, N.Y.

[21] Appl. No.: 51,140

[22] Filed: Apr. 22, 1993

[30] Foreign Application Priority Data

Jun. 19, 1992 [EP] European Pat. Off. ..... 92201805

[51] Int. Cl.[6] ..... H01J 5/50

[52] U.S. Cl. ..... 313/51; 313/318.1; 439/613; 439/616; 439/619; 81/53.11; 81/53.12; 445/69; 445/23

[58] Field of Search ..... 313/49, 51, 318; 439/613, 616, 619; 81/53.11, 53.12; 445/69, 23

[56] References Cited

U.S. PATENT DOCUMENTS

| | | | |
|---|---|---|---|
| 673,191 | 4/1901 | Arthur | 81/53.11 |
| 927,908 | 7/1909 | Webb | 81/53.11 |
| 1,020,732 | 3/1912 | Willard | 439/616 |
| 1,121,759 | 12/1914 | Printiss | 81/53.11 |
| 1,166,189 | 12/1915 | Darby | 81/53.11 |
| 1,757,711 | 5/1930 | Grinnell | 81/53.11 |
| 2,223,344 | 12/1940 | Grinnell | 81/53.11 |
| 2,357,105 | 8/1944 | Grinnell | 81/53.11 |
| 4,396,860 | 8/1983 | Hellwig et al. . | |
| 5,021,706 | 6/1991 | Chen | 313/49 |

FOREIGN PATENT DOCUMENTS

| | | | |
|---|---|---|---|
| 561564 | 10/1923 | France | 81/53.11 |
| 853358 | 1/1941 | France . | |
| 290482 | 3/1990 | Japan . | |
| 290483 | 3/1990 | Japan . | |

OTHER PUBLICATIONS

IEC Publication 7004-14-7, "Bayonet Automobile Caps Culots A Baionnette Pour Automobiles", Dec. 1977.

IEC Publication 7004-11A-7, "Bayonet Automobile Caps Culots A Baionnette Pour Automobiles", Dec. 1977, (2 pages).

*Primary Examiner*—Sandra L. O'Shea
*Assistant Examiner*—Matthew J. Esserman
*Attorney, Agent, or Firm*—Brian J. Wieghaus

[57] ABSTRACT

In a process for mounting a single-capped electric lamp (1) in a lampholder (20) of a luminaire (22), use is made of a cap (3) having an end zone (9) in its shell (4) which in a mounted lamp is outside the lampholder. The end zone (9) is provided with relief (15) enabling a mounting tool (30) to seize the cap (3) with little force and nevertheless to have a firm grip onto the lamp. The position of the relief (15) may be related to the position of coupling device (10) present at the cap (3) for cooperation with the lampholder, enabling the tool (30) to approach the holder (20) with the cap (3) in a predetermined position. By the process it is counteracted that a lamp (1) having a cap (3) which is suited to be used in the process and a luminaire (22) having the holder (20), becomes damaged during assembling.

16 Claims, 1 Drawing Sheet

METHOD OF PLACING A SINGLE-CAPPED ELECTRIC LAMP IN A LAMPHOLDER, SINGLE-CAPPED ELECTRIC LAMP DESIGNED FOR THIS PURPOSE, AND LUMINAIRE PROVIDED WITH THE SINGLE-CAPPED ELECTRIC LAMP

BACKGROUND OF THE INVENTION

The invention relates to a method of placing a single-capped electric lamp in a lampholder of a luminaire, whereby the electric lamp provided with: a lamp cap having a metal shell with an axis, a first end which is closed by an electric insulator, and an open second end with an adjoining end zone, the metal shell having coupling devices outside the end zone for fixing the lamp cap in a lampholder; a light-transmitting lamp vessel with an electric element inside which is connected to contacts of the lamp cap by the conductors, which lamp vessel is fastened in the open second end of the shell, is gripped by a tool, is inserted with its lamp cap into the lampholder which cooperates with the coupling devices of the lamp cap, and is fixed in the lampholder by rotation, the end zone remaining outside the lampholder thereby.

The invention also relates to an electric lamp suitable for use with the method and to a luminaire which is provided with the single-capped electric lamp.

Such a method is generally known. Wherever a large number of lamps are to be placed in holders, as in or for the motorcar industry, automated tools such as robots are used for this purpose. The lampholders may form part of, for example, lighting units which are to be placed at the rear of a car and which comprise lamps for the stop/rear light, reversing light, indicator light, fog rear light.

The tool grips the electric lamp by the lamp vessel or by the end zone of the metal shell.

The coupling device of the lamp cap may consist of screwthread, as is the case with Edison lamp caps. Alternatively, they may consist of projections, as is the case in the lamp according to U.S. Pat. No. 4,396,860, which has symmetrically arranged projections, or of asymmetrically arranged projections, for example, positioned at different heights. It is also possible that more than two projections are present as the coupling means, for example, at equal height but asymmetrically arranged according to Addition 50 610 to FR 853 358, or asymmetrically and at unequal heights according to JP 2-90483. Asymmetrical coupling means serve not only for coupling the lamp to the lampholder, but also as a key for rendering possible the coupling in one position only.

A disadvantage of the known method is that rejects frequently occur: lamp vessels break, for example, because they are gripped with excessive force or because the lamp is screwed home with excessive force; detaching of the lamp vessel from the lamp cap can also occur, during which electrical connections may also be broken; lamp caps are damaged, for example, because the surface of the end zone is scraped off or deformed. Damage of the lamp cap may result in a loss of corrosion resistance. A major disadvantage is that the lamp may suffer damage which is not immediately observable, but which nevertheless leads to early failure of the lamp.

SUMMARY OF THE INVENTION

It is an object of the invention to provide a method of the kind mentioned in the opening paragraph by which damage to the lamp is counteracted, and to provide a lamp suitable for use with the method and a luminaire which is provided with the single-capped electric lamp.

According to the invention, this object is achieved in that the lamp cap has a relief in the end zone of the shell, with which relief the tool engages.

The relief may comprise an indentation in the end zone. This achieves that the tool has a better grip on the lamp, while the lamp need be clamped in with lesser force. In addition, lamps of one kind may all have the relief in the same rotational position relative to the coupling means of the metal shell, for example, relative to the entrance of a screwthread. This renders it simpler to insert the lamp, brought into the correct rotational position, into the lampholder and fix it therein by rotation. It is favorable if the end zone has at least a second relief. A very good grip on the lamp is then possible with little clamping force.

In a favorable embodiment, the electric lamp suitable for use with the method has a relief in the form of a projection. A projection can be universely used; both in lamps; the lamp vessel of which has in the lamp cap circumferentially only a small distance to the shell, and in lamps, as the lamp according to the cited U.S. Pat. No. 4,396,860, where only a flat seal of the lamp vessel enters the lamp cap and where there are accordingly portions with a greater distance between lamp vessel and shell than elsewhere around said seal. A projection is also favorable because of the smaller proneness to wear of tools having recesses. With tools having, for example, a thin projection which is to cooperate with an indentation in the end zone, wear of this projection may reduce the operating life of the tool.

Reliefs in the end zone of the shell of the lamp cap, in particular a projection, more in particular two projections, are of special interest for bayonet lamp caps such as BA9 and BA15 lamp caps. Bayonet lamp caps in fact generally have at most two discrete rotational positions in which they can be inserted into a lampholder. For some types of bayonet lamp caps there is only one rotational position, as is the case with, for example, BAY lamp caps. The coupling means in these cases consist of projections, for example pins, at the metal shell which are present at unequal heights at the shell, which are of unequal lengths, or which enclose unequal angles with one another. A relief in the end zone now renders it possible to provide the tool with information about the rotational position which the coupling means occupy relative to the tool. This renders it possible for the tool to make the lamp approach the lampholder in the correct position. A risk of damage to the lamp or lampholder is avoided by this.

A favorable embodiment of the electric lamp is one which has a projection as the relief which lies in one line with a coupling means in the longitudinal direction of the shell. The tool can then be readily aligned relative to the lampholder. It is also favorable if a second projection, for example, rotated through less than 180° relative to the first projection, or, for example, having a dissimilar length or shape, is present as a relief. In the case of an asymmetrical lamp cap, the tool can then be given information about this asymmetry by the asymmetry of the relief. A projection may consist of a pin connected to the shell, but advantageous is a protuberance provided in the shell itself.

The method and the lamp suitable therefor are especially important if the lamp has a rated operational voltage of up to several tens of V. This is because the lamp cap need not be recessed in a lampholder in that case. Indeed, the IEC standards prescribe a portion projecting from the lampholder for bayonet lamp caps, for example, of at least 4.2 mm in IEC 7004-14-7 for BA9 and at least 2.6 mm in IEC 7004-11A-7 for BA15.

The electric element in the lamp vessel may be a pair of electrodes in an ionizable gas or an incandescent body, possibly in a gas containing a halogen, or alternatively two or more of such elements. The lamp cap may have one or several contacts at the electric insulator, but may in addition have a contact at the shell.

BRIEF DESCRIPTIONS OF THE DRAWINGS

An embodiment of the method according to the invention, of the lamp suitable for use in the method, and of the luminaire comprising this lamp are shown in the drawing, in which:

FIG. 1 shows a step in the method of placing a single-capped electric lamp suitable for use in the method in a lampholder of a luminaire; and FIG. 2 shows a modification of the lamp cap of FIG. 1.

DESCRIPTION OF THE PREFERRED EMBODIMENTS

Figure 1:
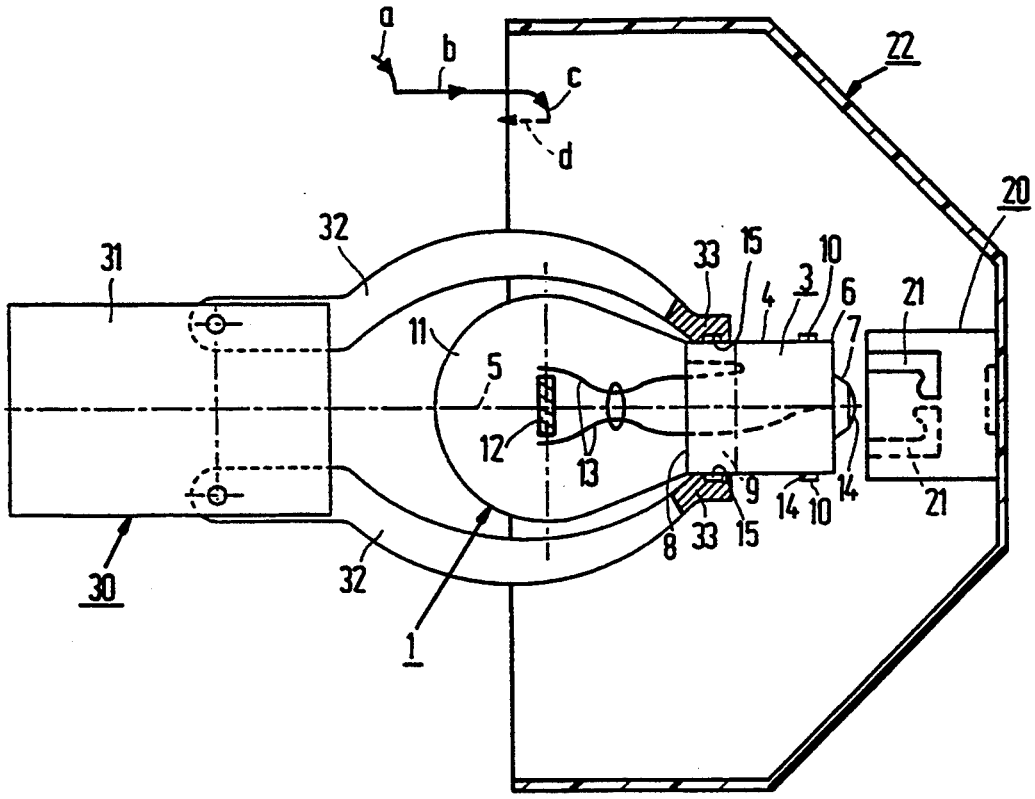

In FIG. 1, the electric lamp 1 is provided with a lamp cap 3 which has a metal shell 4 with a longitudinal axis 5, a first end 6 which is closed by an electric insulator 7, and an open second end 8 with an adjoining end zone 9, the metal shell having coupling device 10 outside the end zone for fixing the lamp cap 3 in a lampholder 20. The coupling device in the Figure consist of two projections which have been pressed out from the shell so as to form a bayonet cap.

The lamp also has a light-transmitting lamp vessel 11 with an electric element 12 inside, an incandescent body in the Figure, which is connected to contacts 14 of the lamp cap 3 by means of conductors 13, which lamp vessel 11 is fastened in the open second end 8 of the shell 4 of the lamp cap 3.

The lamp is gripped by tool 30 and inserted with its lamp cap 3 into a lampholder 20 of a luminaire 22, the lampholder comprising device 21 for cooperating with the coupling device 10 of the lamp cap 3. The device 21 in the Figure consists of substantially L-shaped slots for forming a bayonet lampholder.

The lamp is fixed in the lampholder 20 by rotation, the end zone 9 remaining outside the lampholder 20. In contrast to known lamps, for example, that of the cited JP 2-90483, where the profile of the lamp cap is inside the holder, here the relief present in the end zone will not be inside the lampholder.

The lamp cap 3 has a relief 15 engaging with the tool 30 in the end zone 9 of the shell 4. The relief in the embodiment drawn consists of two projections, protuberances in the Figure, i.e. pressed-out portions of the shell. The tool 30 comprises a head 31 which has movable arms 32 comprising profiled jaws 33 which fit the relief 15 of the lamp cap 3.

The Figure shows the phase in the method in which the tool 30, for example a robot, has gripped the lamp 1 at the relief 15 in the end zone 9 of the shell 4 of the lamp cap 3. The tool 30 then performs a rotation a for aligning the lamp cap 3 relative to the lampholder 20, upon which a translation b is performed for inserting the lamp 1 with its lamp cap 3 into the lampholder, upon which a rotation c is performed for turning the lamp 1 home in the lampholder 20. In the case of a lampholder and a lamp cap of the bayonet type, as shown, the invention offers the possibility for the tool, after the movements a, b and c have been performed, to perform a translation d opposed to the translation b, if so desired, to make sure that the lamp cap has been locked in the bayonet of the lampholder. Lampholders in fact may be designed with such a fit that the elasticity of a contact in the base of the lampholder is not capable of immediately forcing the translation d on the lamp, the moment the tool has released the lamp. If so desired, the lamp may be burned before the tool releases the lamp.

The lampholder forms part of a luminaire 22 which may or may not be provided with a cover plate, which in its turn may or may not be colored, refracting, scattering or transparent.

Since the tool has profiled jaws which match and cooperate with the relief in the end zone of the lamp cap shell, the tool has a grip on the lamp cap and the tool can securely hold the lamp cap with little clamping force. The lamp vessel and the connections with the lamp cap are not loaded at all during this. Since the relief in the embodiment drawn is oriented relative to the coupling means, i.e. in the Figure in the axial direction of the lamp cap in line with these coupling means, it is also possible for the tool to make the lamp cap approach the lampholder in the aligned state, after a rotation a in the case of the lamp drawn.

In the luminaire resulting in FIG. 1, the end zone 9 with the relief is outside the lampholder. The end zone 9 extends between the second end 8 and the dash-dot line drawn parallel thereto.

Figure 2:
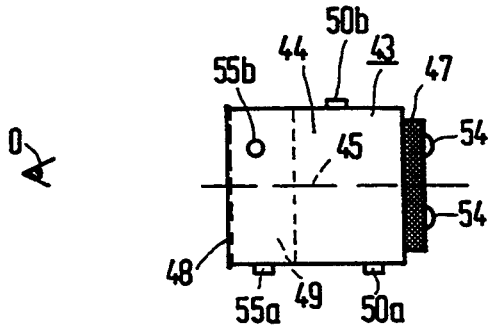

In FIG. 2, portions of the lamp cap 43 corresponding to portions in FIG. 1 have reference numerals which are 40 higher than in FIG. 1. The lamp cap is of the BAY type and has two contacts 54 at its base. The coupling means 50*a, b* are at unequal heights, diametrically opposed to one another and spaced away from one another in the direction of the axis 45. The lamp cap can be placed in a holder designed for it in one discrete manner only. Information about the location of the projection 50*a* and the projection 50*b* is provided to the mounting tool in that the relief in the end zone 49, the projections 55*a* and 55*b*, is also asymmetrical. The projections 55*a*, 55*b* enclose an angle of less than 180° with one another. The projection 55*a* lies in one line with the projection 50*a* in the direction of the axis 45. To an observer O, the coupling device 50*b* lies closer than does 50*a*, and the projection 55*b* of the relief 55*a, b* lies between the coupling device 50*a* and 50*b*. The observer O, who knows the configuration of the coupling device 50*a, b* and of the relief 55*a, b*, can deduce from the position of the relief where the projection 50*a* is located and where the projection 50*b* is located.

We claim:

1. A capped electric lamp suitable for insertion by a tool into a lampholder, said lamp comprising:

(i) a lamp vessel which is energizable for emitting light and (ii) a lamp cap secured to said lamp vessel for electrically connecting and mechanically securing said electric lamp to the lampholder, said lamp cap having a shell with a longitudinal axis, a first, closed end and a second, open end which receives said lamp vessel, said shell having an end portion adjacent said second, open end which protrudes from the lampholder when the lamp cap is fully received in said lampholder, said end portion including a relief therein, and coupling means on said shell outside of said end portion for mechanically securing the lamp cap in the lamp holder.

2. A capped electric lamp as claimed in claim 1, characterized in that the relief comprises at least two projections.

3. An electric lamp according to claim 1, wherein said relief is formed integrally with said end portion of said shell.

4. A capped electric lamp as claimed in claim 1, characterized in that the relief (15) lies in one line with the coupling means seen in the direction of the longitudinal axis.

5. A capped electric lamp as claimed in claim 1, characterized in that the relief comprises a plurality of projections distributed asymmetrically on the circumference of said shell.

6. A capped electric lamp as claimed in claim 1, 2, 4 or 5, characterized in that the lamp cap is a bayonet cap.

7. An electric lamp according to claim 1, 2, 4 or 5, wherein said lamp has a rated voltage of only up to several tens of volts.

8. A method of placing a single capped electric lamp in a lampholder having means for receiving coupling means of a lamp cap, said method comprising the steps of:

a) providing an electric lamp having (i) a lamp vessel which is energizable for emitting light and (ii) a lamp cap secured to said lamp vessel for electrically connecting and mechanically securing said electric lamp to the lampholder, said lamp cap having a shell with a longitudinal axis, a first, closed end and a second, open end which receives said lamp vessel, said shell having an end portion adjacent said second, open end which protrudes from the lampholder when the lamp cap is fully received in said lampholder, said end portion including a relief therein, and coupling means on said shell outside of said end portion for mechanically securing the lamp cap in the lamp holder;

b) gripping said relief in said end portion of said shell with a tool;

c) inserting said lamp cap, with said tool, into the lampholder with rotation, said end portion and said relief remaining outside of said shell; and d) removing said tool from said relief.

9. A method according to claim 8, wherein said relief comprises a projection.

10. A method as claimed in claim 8, characterized in that the relief comprises at least two projections.

11. A method as claimed in claim 8, characterized in that the relief lies in line with the coupling means in the direction of the longitudinal axis.

12. A method as claimed in claim 8, characterized in that the relief comprises a plurality of projections distributed asymmetrically on the circumference of the said shell.

13. A method as claimed in claim 8, 9, 10, 11 or 12, characterized in that the lamp cap is a bayonet cap.

14. A method according to claim 8, wherein said lamp has a rated voltage of only up to several tens of volts.

15. A method according to claim 8, wherein said relief is formed integrally with said end portion of said shell.

16. A luminaire, comprising:

a) a lampholder;

b) an electric lamp comprising a lamp cap having a metal shell with a longitudinal axis, a first end which is closed by an electric insulator, and an open second end with an adjoining end zone, the metal shell having coupling means outside the end zone for fixing the lamp cap in the lampholder, the end zone extending axially beyond the lampholder when the lamp cap is fully received in the lampholder, and a light-transmitting lamp vessel including an electric element therein electrically connected to the lamp cap by means of conductors, which lamp vessel is fastened in the open second end of the shell of the lamp cap, the lampholder comprising means for cooperating with the coupling means of the lamp cap, the lamp cap being fixed in the lampholder by rotation, and the lamp cap having projections in the end zone of the shell.

* * * * *